US008961003B2

(12) United States Patent
Stranczl et al.

(10) Patent No.: US 8,961,003 B2
(45) Date of Patent: Feb. 24, 2015

(54) TIMEPIECE BALANCE SPRING

(71) Applicant: Nivarox-FAR S.A., Le Locle (CH)

(72) Inventors: Marc Stranczl, Nyon (CH); Thierry Hessler, St-Aubin (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/217,981

(22) Filed: Mar. 18, 2014

(65) Prior Publication Data

US 2014/0286140 A1 Sep. 25, 2014

(30) Foreign Application Priority Data

Mar. 19, 2013 (EP) ..... 13160028

(51) Int. Cl.

| | |
|---|---|
| ***G04B 17/04*** | (2006.01) |
| ***G04B 17/06*** | (2006.01) |
| ***G04B 17/32*** | (2006.01) |
| ***G04B 15/14*** | (2006.01) |

(52) U.S. Cl.

CPC ..... *G04B 17/063* (2013.01); *G04B 17/066* (2013.01); *G04B 17/325* (2013.01); *G04B 15/14* (2013.01)

USPC ..... 368/175; 368/176

(58) Field of Classification Search

CPC ..... G04B 17/06; G04B 17/32; G04B 17/325

USPC ..... 368/127, 169, 175, 178

See application file for complete search history.

(56) References Cited

U.S. PATENT DOCUMENTS

| | | | | |
|---|---|---|---|---|
| 3,395,532 | A | 8/1968 | Schneider | |
| 6,666,575 | B2 * | 12/2003 | Scheufele | 368/127 |
| 8,240,910 | B2 * | 8/2012 | Orny et al. | 368/169 |
| 2003/0179655 | A1 * | 9/2003 | Scheufele | 368/127 |
| 2005/0073912 | A1 * | 4/2005 | Geyer | 368/127 |
| 2007/0140065 | A1 * | 6/2007 | Levingston | 368/127 |
| 2009/0116343 | A1 * | 5/2009 | Levingston | 368/140 |
| 2010/0027382 | A1 | 2/2010 | Daout et al. | |
| 2011/0249537 | A1 | 10/2011 | Daout et al. | |
| 2012/0082010 | A1 | 4/2012 | Boulenguiez et al. | |

FOREIGN PATENT DOCUMENTS

| | | |
|---|---|---|
| CH | 447 042 | 3/1968 |
| EP | 2 151 722 A1 | 2/2010 |
| EP | 2 437 126 A1 | 4/2012 |
| EP | 2 605 079 A1 | 6/2013 |
| EP | 2 605 087 A1 | 6/2013 |

OTHER PUBLICATIONS

European Search Report issued Aug. 27, 2013, in Patent Application No. EP 13 16 0028, filed Mar. 19, 2013 (with English-language translation).

* cited by examiner

*Primary Examiner* — Vit W Miska

(74) *Attorney, Agent, or Firm* — Oblon, Spivak, McClelland, Maier & Neustadt, L.L.P.

(57) ABSTRACT

A timepiece escape mechanism sub-assembly includes at least one bar and at least one balance spring. The outer end of the balance spring is secured to a balance spring stud. The balance spring and the balance spring stud associated therewith form a single-piece assembly with the bar.

15 Claims, 4 Drawing Sheets

TIMEPIECE BALANCE SPRING

This application claims priority from European patent application No. 13160028.0 filed Mar. 19, 2013, the entire disclosure of which is hereby incorporated by reference.

FIELD OF THE INVENTION

The invention concerns a timepiece escape mechanism including at least one bar and at least one balance spring, the outer end of which is secured to a balance spring stud.

The invention also concerns a mechanical timepiece movement including at least one sub-assembly of this type.

The invention concerns the field of timepiece mechanisms, and more specifically escape mechanisms incorporating functional, ready-to-use modules.

BACKGROUND OF THE INVENTION

The use of modular assemblies permits the manufacture of families of products using a common base, each personalised by different options or functions, notably complications in the case of a mechanical timepiece movement.

The concept of extremely high precision modules or sub-assemblies allows large scale production to be combined with high quality goods.

Thus, modular sub-assemblies for timepiece movements are known, from EP Patent Application Nos. 11193173.9 and 11193174.7 in the name of ETA SA. The mechanical modules disclosed in these Patent Applications are irreversibly pre-adjusted and assembled to ensure the durability of their settings.

However, in a conventional embodiment, the modules do not always allow for a reduction in the number of components, which would both reduce production costs and simplify the assembly plan, enabling mid-level technical personnel to assemble and adjust the most complex functions.

CH Patent No 447042 in the name of TISSOT discloses a device for securing the outer end of a balance spring, including a rigid support comprising projecting studs between which the balance spring is threaded in a sinuous path, and held laterally by an overlapping portion comprised in one of the studs.

EP Patent Application No 2151722A1 in the name of ROLEX discloses a balance spring with at least two coplanar strips wound with an offset capable of neutralising the lateral forces likely to be exerted on the central arbour when one of the ends of each strip is angularly shifted about the arbour, relative to the other end of the strip. In a variant, the strips are joined to each other by their respective two inner and outer ends.

EP Patent Application No 2347126A1 in the name of ROLEX discloses a balance spring wherein the outer end of a strip of the balance spring is fabricated integrally with a member for connection to the timepiece frame, the rigidity of this connecting member being greater than that of the spring. The connecting member and the frame have complementary bearing surfaces.

SUMMARY OF THE INVENTION

Thus, the invention proposes to provide sub-assemblies with a reduced number of components having average assembly and adjustment complexity.

In particular, the assembly of a balance spring is an operation which is difficult to automate. The concept of a balance spring integrated in an easier-to-handle sub-assembly permits improved automation of the assembly.

The present invention utilises, for this purpose, the new micro-component fabrication technologies, MEMS, "LIGA", lithography and suchlike, to optimise the manufacture of the modules, shown here as sub-assemblies. These sub-assemblies may, depending on the case, be irreversibly assembled to each other as in the above two Patent Applications, or positioned and assembled in a conventional manner.

The invention concerns a timepiece escape mechanism sub-assembly including at least one bar and at least one balance spring, the outer end of which is pinned up to a balance spring stud, characterized in that at least one said balance spring and said balance spring stud associated therewith form a single-piece assembly with said bar.

According to a feature of the invention, at least one said stud is position adjustable and is locked in a pre-adjusted position by a locking means.

According to a feature of the invention, said stud is secured to said bar by an elastic return means in a single piece with said stud and said bar.

The invention also concerns a mechanical timepiece movement including at least one sub-assembly of this type.

The advantage of making components in a single-piece, and in particular with the plate or the bars, is that the number of parts is reduced, and assembly problems are avoided. The invention benefits from the precision with which these monolithic components are made (typically, the parts are for example made of silicon and therefore enjoy micrometric precision).

The monolithic sub-assembly has the main advantage of guaranteeing the distances between centres and of forming a ready-to-use mechanism, in particular an oscillator in a preferred application.

The invention incorporates, in particular, flexible guiding supports, which have the following advantages:

guaranteed precision;

very reduced or zero friction level;

no hysteresis in the movements, due to the absence of friction or at least the extremely reduced level of friction;

no lubrication;

no play;

no wear.

The manufacture of the flexible guiding supports results in limitations, notably a limited travel, low return forces, and a limited charge. However, these limitations are not prohibitive for a number of horological functions, in particular those which relate to regulation.

These limitations are amply compensated for by the high precision of the distance between centres, the small number of components to be made and hence the reduced complexity and assembly time. A sub-assembly according to the invention has a great industrial advantage: the mechanism, particularly an oscillator, in a sub-assembly forms a component ready for assembly in a movement. Further, there is nothing to prevent an entire movement being devised in the form of a sub-assembly of the invention.

BRIEF DESCRIPTION OF THE DRAWINGS

Other features and advantages of the invention will appear upon reading the following detailed description, with reference to the annexed drawings, in which:

FIG. 7 illustrates the adjustment of a pivot for hooking a balance spring via elastic adjustment means including a comb, the locking in position of the comb in an adjusted position, and a locking mechanism controlling the clamping means. FIG. 8 illustrates a similar example wherein the comb is held between two flexible strips and forms a bistable component. FIG. 9 illustrates a similar mechanism with a comb immobilising an index located at the end of a flexible strip, the comb being pressed onto the index by a strip-spring clamp which is in turn immobilised by a locking finger.

DETAILED DESCRIPTION OF PREFERRED EMBODIMENTS

The invention concerns the field of timepiece mechanisms, and more specifically movements integrating functional, ready-to-use modules.

The invention concerns a timepiece escape mechanism sub-assembly 1 including at least one bar 3 and at least one balance spring 71, the outer end of which is secured to a balance spring stud 73.

According to the invention, at least one balance spring 71 of this type and the stud 73 associated therewith form a single-piece assembly with bar 3.

Figure 7:
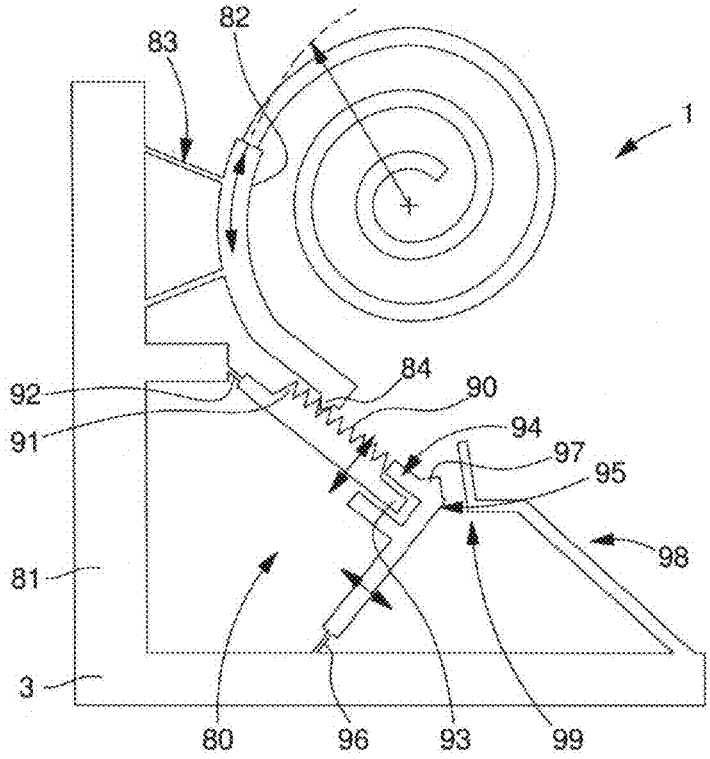
FIGS. 7, 8 and 9 show plan views of a monolithic sub-assembly including a position adjustment means for a component which is also integrated in the assembly, the adjustment means being lockable in position by a clamping means.
Figure 8:
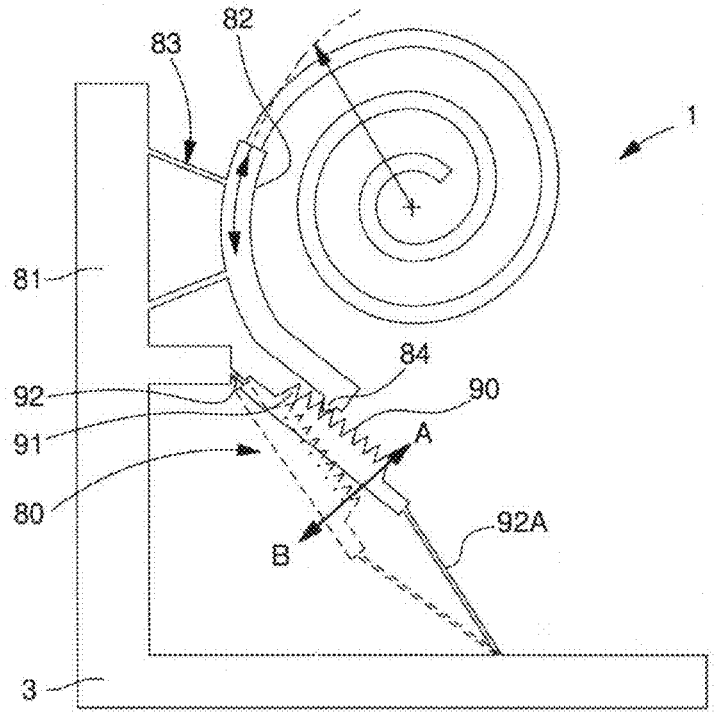
Figure 9:
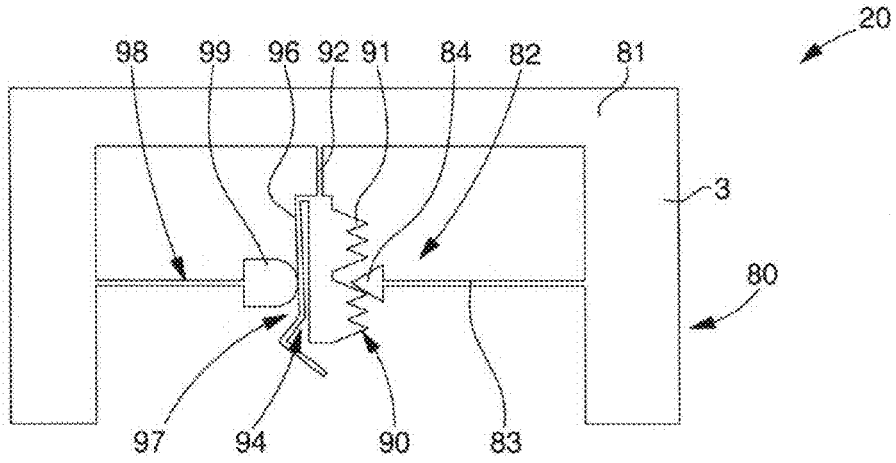

In an advantageous variant, as seen in FIGS. 7 to 9, at least one stud 73 of this type is position adjustable and is immobilised in a pre-adjusted position by a locking means.

Figure 1:
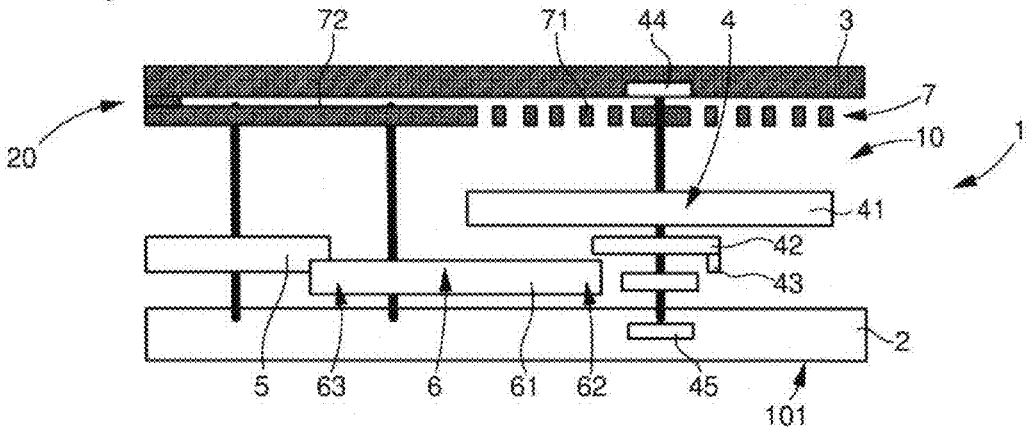
FIG. 1 shows a schematic side view of a sub-assembly according to the invention, for the particular case of an escape mechanism and including a balance spring made in a single-piece with a bar.

FIG. 1 illustrates a case where the stud is integral with a plate 72 in the plane of a balance spring 71, parallel to the plane of the actual bar 3 and integral therewith, all forming a single-piece component 20.

Figure 2:
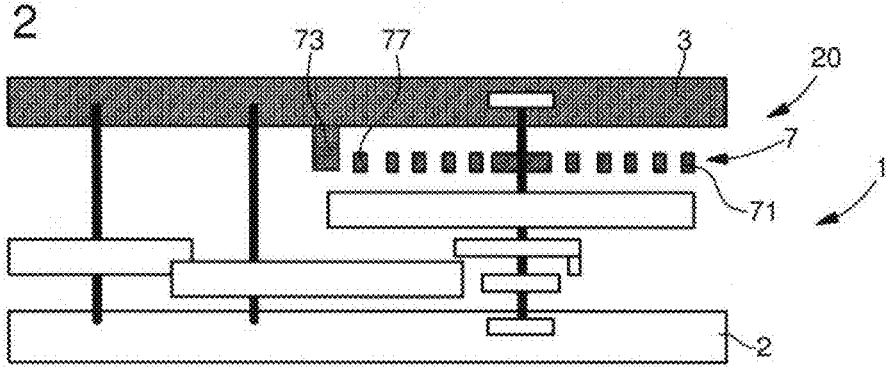
FIG. 2 shows, in a similar manner to FIG. 1, a similar variant.

FIG. 2 illustrates a case where stud 73 projects from bar 3 and where the end of stud 73 is in the plane of balance spring 71, parallel to the plane of bar 3, all forming a single-piece component 20.

Figure 3:
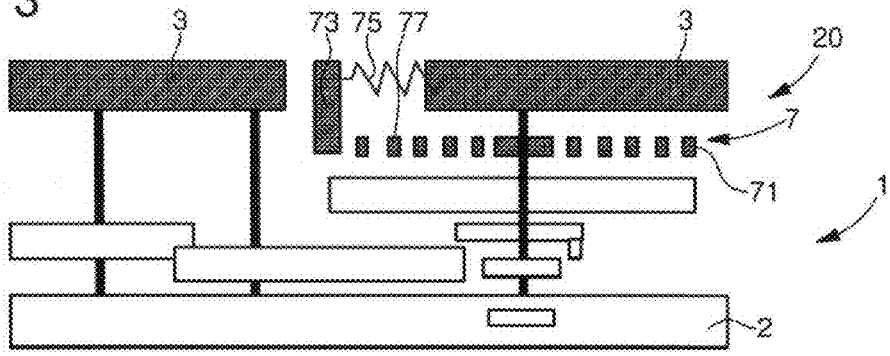
FIG. 3 shows, in a similar manner to FIG. 1, a variant wherein the balance spring is made in a single piece with a stud, which is in turn made in a single piece with the bar to which it is connected by integrated elastic return means.
Figure 4:
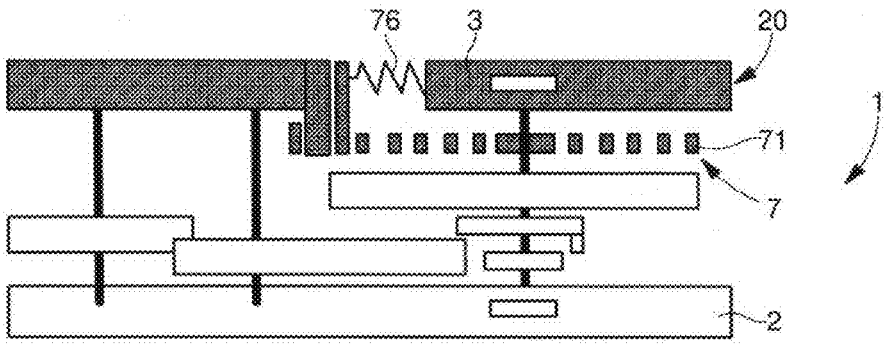
FIG. 4 shows, in a similar manner to FIG. 1, a variant wherein the balance spring is made in a single piece with a stud, which is in turn in a single piece with the bar, and wherein the outer end of the balance spring is clamped by pins formed in a single piece with the bar, and at least one of which is connected by integrated elastic return means to the bar.

FIG. 3 and FIG. 4 illustrate cases where stud 73 extends over two levels at the same time: that of balance spring 71 and that of bar 3, all forming a single-piece component 20.

As seen in particular in FIG. 2 or 3, balance spring 71 is made in a single piece with a stud 73 to which the balance spring is attached via its outer coil 77. This stud 73 is in turn made in a single-piece with bar 3, to which it is connected by second integrated elastic return means 75 made in a single piece both with stud 73 and with bar 3. Preferably, the stud position adjustment, achieved by exploiting the elasticity of the second elastic return means, is maintained by a clamping means, not shown in FIG. 3, but an example of which is shown in FIGS. 7 and 9.

The adjustment of the active length of the outer coil of balance spring 71 may be achieved in various manners.

In a variant, the outer coil 77 of balance spring 71 is clamped by two pins 74A, 74B in a single-piece with bar 3.

In another variant, at least one of pins 74 is secured to the top bar 3 by a second elastic return means 76, which is in a single piece with said at least one pin 74A or 74B and bar 3, and which tends to move said pin closer to the other pin 74B or 74A.

FIG. 4 therefore shows a variant of the FIG. 3 embodiment, wherein balance spring 71 is also made in a single piece with a stud 73, which is in turn made in a single piece with bar 3, and wherein the outer end of the balance spring is clamped, at a distance from stud 73, by pins 74A and 74B in a single piece with bar 3, together forming the equivalent of an index 74 for modifying the active length of balance spring 71.

Figure 6:
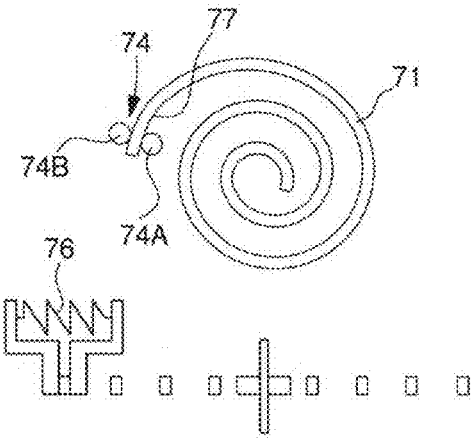
FIG. 6 shows a plan view and a side view of a pair of pins of this type clamping the balance spring under the effect of of integrated elastic return means.

In an embodiment without any play, as seen in FIG. 6, at least one of these pins 74A and 74B is connected and secured to bar 3 by an elastic return means 76, also integrated in bar 3, which is in a single-piece with said at least one pin 74 and with bar 3 and which tends to move said pin closer to the other pin 74.

Figure 5:
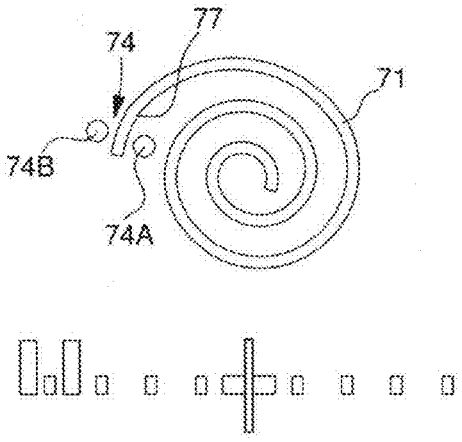
FIG. 5 shows a plan view and a side view of conventional pins with play.

FIG. 5, however, illustrates an embodiment with very slight play, wherein the radial, independent adjustment of pins 74A and 74B adjusts the isochronism of the movement in the various positions.

This elastic return means 76 is formed, in particular, of one or more flexible elements, located either in the plane of balance spring 71, or in the plane of bar 3, or in any other plane. In an advantageous variant, balance spring 71 and/or pins 74A or 74B may be notched locally to allow for discrete, notch-by-notch adjustment.

To allow easy pre-adjustment of mechanism 1, at least one of its components is position adjustable and is locked in a pre-adjusted position by a locking means.

In a particular variant, illustrated in FIGS. 7 to 9, sub-assembly 1 includes a position adjustable mechanism 80 which includes a rigid structure 81. This rigid structure 81 is preferably formed by bar 3 and carries, via at least one resilient strip 83, at least one position adjustable component 82 (notably formed by a stud or carrying a stud 73). This adjustable component 82 includes an indexing means 84 arranged to cooperate with a complementary indexing means 91 comprised in an adjustment mechanism 90. This complementary indexing means 91 is mounted so as to be able to be uncoupled from to indexing means 84 and can be locked in a cooperating position by a clamping mechanism 94 resiliently secured to structure 81. Clamping mechanism 94 is in turn subject to the action of a locking mechanism 98 which allows mechanism 94 to occupy either an uncoupled position in which adjustment mechanism 90 is free, or a coupled position in which clamping mechanism 94 hinders adjustment mechanism 90. Locking mechanism 98 is in turn also resiliently secured to structure 81.

In a variant, this position adjustable mechanism 80 carries a position adjustable component 82, which carries a bearing 44 or a bearing carrier 13 for receiving the pivot of a balance 41 intended to receive the inner end of balance spring 71 with the same architecture as before.

In the case of FIG. 7, this position adjustable component 82 includes an indexing means 84, which is arranged to cooperate with a complementary indexing means 91, here formed by a comb, or a toothed sector, comprised in adjustment mechanism 90. This complementary indexing means 91 is mounted so as to be able to be uncoupled from to indexing means 84. It can also be locked in a cooperating position by a clamping mechanism 94.

This clamping mechanism 94 is resiliently secured to structure 81 by at least one flexible element 96 and is preferably in turn subject to the action of a locking mechanism which allows mechanism 94 to occupy either an uncoupled position in which adjustment mechanism 90 is free, or a coupled position in which clamping mechanism 94 hinders adjustment mechanism 90. This locking mechanism includes at least one flexible element 98 forming a jumper and resiliently secured to structure 81, said at least one flexible element 98 here includes a beak 99 which cooperates with a beak 97 of clamp 94 to hold the clamp away during the position adjustment, or with a complementary stop surface 95 of clamp 94 as security for the clamp when the position adjustment is carried out. The latter is in the form of a fork so as to limit the travel of an arm 93 comprised in comb 91.

FIG. 8 illustrates a similar example where comb 91 is held between two substantially aligned flexible strips 92 and 92A and form a bistable component, operating by buckling, the assembly can occupy two stable positions: a first activated position A where comb 91 cooperates with a finger 84 of a moveable stud 82 and a second release position B where the comb is uncoupled from the finger.

FIG. 9 illustrates a similar mechanism with a comb 91 locking an index 84 located at the end of a flexible strip 83, comb 91 being pressed onto index 84 by a strip-spring clamp 96 belonging to clamp 94, which is in turn locked by a locking finger 99 mounted on at least one flexible strip 98, said finger 99 cooperating with a stop surface 97 of strip 96.

As seen above, this combined adjustment, clamping and locking mechanism, illustrated here for a particular application of adjusting a stud on a travel concentric to the axis of a balance spring, is applicable to a wide range of applications: positioning a bearing, a stop member, an index pin, or other element.

Figure 10:
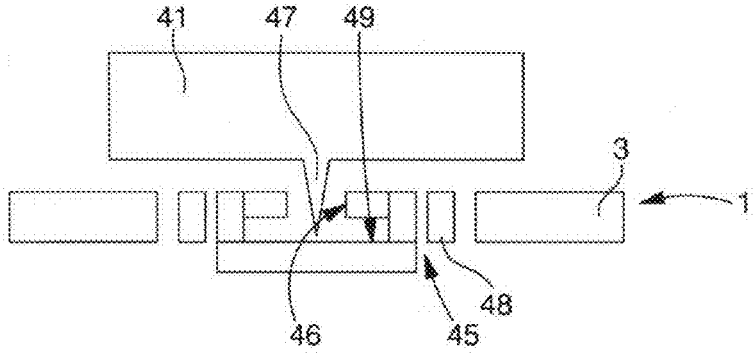
FIG. 10 shows a cross-section through the arbour of a pivot with a shock absorber bearing in a single-piece with a plate or a bar.
Figure 11:
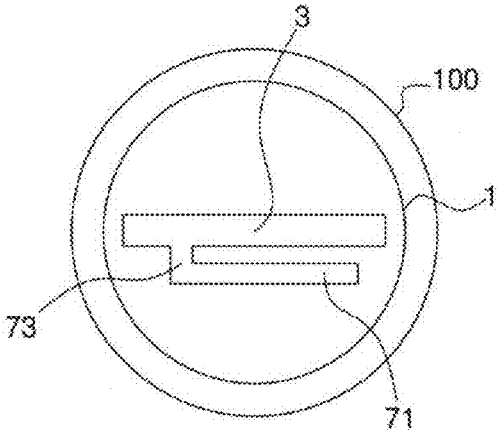
FIG. 11 is a diagram of a timepiece movement including a sub-assembly according to the invention.

In a variant according to FIG. 10, bar 3 forms an inseparable single-piece component with at least one shock absorber bearing for receiving a pivot of a balance 41 intended to receive the inner end of balance spring 71, or of a component of the escape mechanism.

Figure 4A:
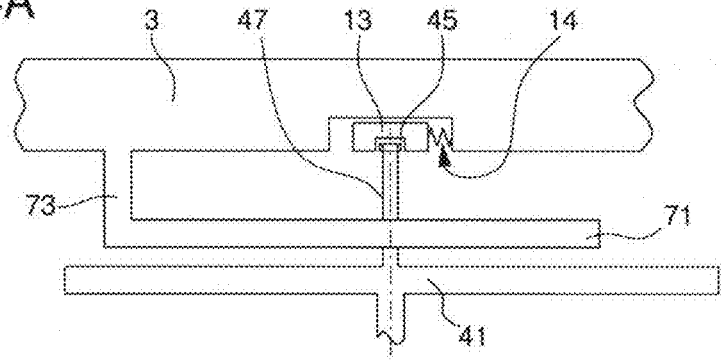
FIG. 4A shows a bar which, for pivoting a balance intended to receive the inner end of the balance spring, includes a pivot housed in a bearing carrier connected to the bar by an elastic return means.

In particular, in an advantageous variant seen in FIG. 4A, for pivoting a balance 41 intended to receive the inner end of balance spring 71, bar 3 includes a pivot 45 housed in a bearing carrier 13 connected to bar 3 by an elastic return means 14. Likewise, this pivot 45 may be arranged on plate 2.

Pivot 45 may be formed by a conventional pivot or by a flexible guiding support.

In a particular version, pivot 45 is a flexible guiding support in a single piece with bar 3 or with plate 2, depending on the case.

In particular version (not illustrated), one end of balance 41 is in a single-piece with a flexible guiding support and bar 3 (or respectively plate 2), the balance then has a travel which is limited by the clearance of the flexible guiding support, which is then advantageously made in several stages to allow for a sufficient angular travel of the balance, which is then in a single piece with bar 3 (or respectively plate 2). More specifically, this type of flexible guiding support may be formed by the actual balance spring 71.

In another variant (not illustrated), balance 41 is hooked both to bar 3 and to plate 2, on each side by a flexible guiding support forming a balance spring 71, these two balance springs 71 exerting torques, either in the same direction or in opposite directions.

Preferably, this elastic return means 14 is in a single-piece with bar 3 and bearing carrier 13, and in a variant, pivot 45 also forms part of this single-piece sub-assembly 1.

In a particular embodiment of sub-assembly 1, bar 3 includes at least one bearing 44 or 45, or a bearing carrier 13 for receiving the pivot of a balance 41 intended to receive the inner end of balance spring 71, and at least said bearing 44 or 45, or said bearing carrier 13 is made in a single-piece with bar 3, and includes a shoulder of revolution 46 for radially holding an arbour 47 of balance 41, and a frontal shoulder 49 for axially limiting the end of said arbour 47, the shoulder of revolution 46 and frontal shoulder 47 being carried together by a resilient shock absorber 48 also in a single-piece therewith.

In an advantageous embodiment, sub-assembly 1 is made of silicon. The pivot points of pivots 45 are defined, for example, by anisotropic (KOH) etches in a silicon substrate. A version with an assembly of jewels is also possible. The great advantage is the very precise positioning of the pivot points (distance from centres, verticality).

The shock absorbers may thus be partially or totally made inside the plate: the shock absorber spring may be made jointly with the plate. One of the two (or both) jewels may be made jointly with the plate. The pivoting then occurs directly in the silicon. The pivot points may be made straight in the silicon with DLC or other surface coatings. There are thus no more jewels and the points of rotation are very precisely positioned.

In a particular embodiment, sub-assembly 1 includes severable elements intended to facilitate the assembly of the sub-assembly in a larger assembly, these severable elements then only have to be broken off to give one or more degrees of freedom to certain of the constituents thereof. In particular, these severable elements are located at the inner end of the balance spring, in conjunction with the bar, and are only broken off when balance 41 is assembled and balance spring 71 is secured to the collet of the balance.

In a particular variant (not illustrated), sub-assembly 1 comprises an entire escape mechanism.

In a particular embodiment, the integrated elastic return means comprised in sub-assembly 1 includes at least one flexible bistable or multi-stable element, as seen for example in FIG. 8, which shows a bistable element working by buckling, and including a comb 91 between two substantially aligned resilient strips 92 and 92A, the assembly being capable of occupying two stable positions; a first activated position A where comb 91 cooperates with a finger 84 of a moveable stud 82, and a second release position B where it is uncoupled therefrom.

In an advantageous embodiment of sub-assembly 1 according to the invention made of silicon, the integrated elastic return means comprised therein is pre-stressed in an oxidised silicon state.

In an advantageous embodiment of sub-assembly 1 according to the invention, bar 3 is made of micromachinable material, or silicon, or oxidised silicon, and the integrated elastic returns means comprised therein is pre-stressed in an oxidised silicon state. Other materials in MEMS or "LIGA" technology may be employed. Quartz, DLC, at least partially amorphous materials or metallic glasses, may be used for these applications, although the list is not limiting.

Particular structuring of bar 3 and/or the inseparable single-piece components comprised therein can compensate for the effects of expansion of these structural elements or of components of mechanism sub-assembly 1. It is, for example, possible to make the bar 3 in silicon, and then oxidise it, for the sake of consistency.

The invention also concerns a mechanical timepiece movement 100 including at least one sub-assembly 1 of this type.

What is claimed is:

1. A timepiece escape mechanism sub-assembly, comprising:

at least one bar; and at least one balance spring, an outer end of said at least one balance spring being secured to a balance spring stud, wherein said balance spring and said balance spring stud associated therewith form a single-piece assembly with said bar, and wherein said balance spring stud is position adjustable with respect to the bar and is locked in a pre-adjusted position by a locking mechanism.

2. A mechanical timepiece movement, comprising:

at least one sub-assembly according to claim 1.

3. A timepiece escape mechanism sub-assembly comprising:

at least one bar; and at least one balance spring, an outer end of said at least one balance spring being secured to a balance spring stud, wherein said at least one balance spring and said balance spring stud associated therewith form a single-piece assembly with said bar, and wherein said stud is fixed to said bar by an elastic return means which is in a single piece with said stud and said bar.

4. The sub-assembly according to claim 3, wherein said elastic return means includes a spring.

5. A timepiece escape mechanism sub-assembly comprising:

at least one bar; and at least one balance spring, an outer end of said at least one balance spring being secured to a balance spring stud, wherein said at least one balance spring and said balance spring stud associated therewith form a single-piece assembly with said bar, and wherein said balance spring includes an outer coil which is clamped by two pins in a single piece with said bar.

6. The sub-assembly according to claim 5, wherein at least one of said pins is secured to said bar by an elastic return means which is in a single piece with said at least one pin and said bar, and which tends to move said pin closer to the other said pin.

7. The sub-assembly according to claim 6, wherein said elastic return means includes a spring.

8. A timepiece escape mechanism sub-assembly comprising:

at least one bar; and at least one balance spring, an outer end of said at least one balance spring being secured to a balance spring stud, wherein said at least one balance spring and said balance spring stud associated therewith form a single-piece assembly with said bar, and wherein said bar forms an inseparable single-piece component with at least one shock absorber bearing for receiving a pivot of a balance intended to receive an inner end of said balance spring or of a component of said escape mechanism.

9. A timepiece escape mechanism sub-assembly comprising:

at least one bar; and at least one balance spring, an outer end of said at least one balance spring being secured to a balance spring stud, wherein said at least one balance spring and said balance spring stud associated therewith form a single-piece assembly with said bar, and wherein, for pivoting a balance intended to receive an inner end of said balance spring, said bar includes a pivot housed in a bearing carrier connected to said bar by an elastic return means.

10. The sub-assembly according to claim 9, wherein said elastic return means includes a spring.

11. A timepiece escape mechanism sub-assembly comprising:

at least one bar; and at least one balance spring, an outer end of said at least one balance spring being secured to a balance spring stud, wherein said at least one balance spring and said balance spring stud associated therewith form a single-piece assembly with said bar, and wherein the sub-assembly includes a position adjustable mechanism including a rigid structure carrying, via at least one elastic strip, a position adjustable component carrying one said stud and including an indexing means arranged to cooperate with a complementary indexing means comprised in an adjustment mechanism, said complementary indexing means being mounted so as to be able to be uncoupled from the indexing means and being lockable in a cooperating position by a clamping mechanism resiliently secured to said structure, said clamping mechanism being in turn subject to an action of a locking mechanism which allows said clamping mechanism to occupy either an uncoupled position wherein said adjustment mechanism is free, or a coupled position wherein said clamping mechanism hinders said adjustment mechanism, said locking mechanism being also resiliently secured to said structure.

12. A timepiece escape mechanism sub-assembly comprising:

at least one bar; and at least one balance spring, an outer end of said at least one balance spring being secured to a balance spring stud, wherein said at least one balance spring and said balance spring stud associated therewith form a single-piece assembly with said bar, and wherein the sub-assembly includes a position adjustable mechanism including a rigid structure carrying, via at least one elastic strip, a position adjustable component carrying a bearing or a bearing carrier for receiving a pivot of a balance intended to receive an inner end of said balance spring and including an indexing means arranged to cooperate with a complementary indexing means comprised in an adjustment mechanism, said complementary indexing means being mounted so as to be able to be uncoupled from the indexing means and being lockable in a cooperating position by a clamping mechanism resiliently secured to said structure, said clamping mechanism being in turn subject to an action of a locking mechanism which allows said clamping mechanism to occupy either an uncoupled position wherein said adjustment mechanism is free, or a coupled position wherein said clamping mechanism hinders said adjustment mechanism, said locking mechanism being also resiliently secured to said structure.

13. A timepiece escape mechanism sub-assembly comprising:

at least one bar; and at least one balance spring, an outer end of said at least one balance spring being secured to a balance spring stud, wherein said at least one balance spring and said balance spring stud associated therewith form a single-piece assembly with said bar, and wherein said bar includes at least one bearing or one bearing carrier for receiving a pivot of a balance intended to receive an inner end of said balance spring, and in that at least one said bearing or bearing carrier is made in a single piece with said bar and includes a shoulder of revolution for radially holding an arbour of said balance, and a frontal shoulder for axially limiting an end of said arbour, said shoulder of revolution and said frontal shoulder being carried together by a resilient shock absorber which is also in a single piece therewith.

14. A timepiece escape mechanism sub-assembly comprising:

at least one bar;

at least one balance spring, an outer end of said at least one balance spring being secured to a balance spring stud; and an integrated elastic return means, wherein said at least one balance spring and said balance spring stud associated therewith form a single-piece assembly with said bar, and wherein said integrated elastic return means is pre-stressed in an oxidised silicon state.

15. The sub-assembly according to claim 14, wherein the integrated elastic return means includes a spring.

* * * * *